United States Patent [19]

Church et al.

[11] 4,102,085

[45] Jul. 25, 1978

[54] ABRASIVE COATED SHARPENING TOOL AND METHOD OF MAKING IT

[75] Inventors: Peter K. Church, Cascade; Alan G. Phillips, Colorado Springs, both of Colo.

[73] Assignee: Kaman Sciences Corporation, Colorado Springs, Colo.

[21] Appl. No.: 719,729

[22] Filed: Sep. 2, 1976

[51] Int. Cl.[2] ..... B24D 3/06; B24D 3/10

[52] U.S. Cl. ..... 51/295; 51/309 R

[58] Field of Search ..... 51/309, 295, 308, 307; 264/60

[56] References Cited

U.S. PATENT DOCUMENTS

| | | | |
|---|---|---|---|
| 2,369,709 | 2/1945 | Baumann et al. | 51/309 |
| 3,220,860 | 11/1965 | Robiette et al. | 51/309 |
| 3,293,012 | 12/1966 | Smiley et al. | 51/309 |
| 3,789,096 | 1/1974 | Church et al. | 264/60 |
| 3,841,852 | 10/1974 | Wilder et al. | 51/309 |
| 4,007,020 | 2/1977 | Church et al. | 264/60 |

*Primary Examiner*—Donald J. Arnold

*Attorney, Agent, or Firm*—Max L. Wymore

[57] ABSTRACT

A new type of knife sharpening tool having a cutting surface consisting of abrasive grains embedded and held in place in a ceramic-metal matrix, chemically bonded to a substrate such as a steel core and method of making same.

15 Claims, No Drawings

ABRASIVE COATED SHARPENING TOOL AND METHOD OF MAKING IT

This invention relates to a new knife sharpening tool and more specifically to a new sharpening "steel." The cutting surface of the steel consists of abrasive grains held in place in a ceramic-metal matrix, chemically bonded to a substrate such as a steel core. This results in a sharpening steel that can produce a very uniform and extremely sharp cutting edge on the blade being sharpened as well as providing a rugged and long life sharpening tool.

Prior art sharpening tools include the conventional serrated, hardened sharpening steels that are similar to a fine metal file and the cutting edges of which become dull rapidly with use as the knife blade being sharpened is usually as hard as the steel.

The prior art sharpening tools also include ceramic sharpening steels; however, these are easily broken because of the brittle nature of the ceramic rod. While these provide good to excellent sharpening characteristics when new, once the cutting edges on the exposed granular surface become dull no new cutting edges can be exposed. Also the grain structure is not highly reproducible and is therefore difficult to manufacture according to customer specifications.

There is also a chromium carbide surfaced steel sharpener in the prior art that has a very hard, but very thin coating.

Sharpening tools are also available with diamonds embedded in a metal core. These are very hard and initially good but the diamond abrasive is so brittle that steels of this type wear out rapidly.

Also there are silicon carbide and alumina sticks produced like a hone or grinding wheel. These wear out rapidly and usually have open pores that load with metal that degrades cutting action.

It is the principal object of the present invention to provide a sharpening tool that overcomes the disadvantages of the prior art devices.

It is a further object of the present invention to provide a sharpening tool having a core or substrate and a coating of abrasive thereon.

A further object of the present invention is to provide an improved sharpening tool that is highly durable, is essentially non-loading and provides a harder cutting surface than like prior art devices.

A still further object of the invention is to provide an improved sharpening tool having a steel core and a relatively thick ductile coating provided with tough, non-brittle abrasive grain to be newly exposed as required.

In accordance with the present invention a substrate is provided to which an abrasive coating can be adhered. The substrate may have a predetermined shape such as that of a sharpening steel. The abrasive coating is initially applied to the substrate in an aqueous slurry form by dipping, spraying, brushing and the like. The slurry consists basically of a suitable mixture of metal powder, abrasive grain, water and a water soluble chromium compound. A small amount of a suspension agent such as Kaolin, Cab-O-Sil and the like may be added to help keep the powders in suspension. When used in small amounts the suspension additive does not have a noticeable effect on the cutting properties of the sharpening steel.

The slurry coating, after being applied to the substrate, is then dried and thermally cured in an initial heat cycle at a temperature high enough to chemically convert the chromium compound to a water insoluble chromium oxide but low enough to prevent excessive oxidation of the metal powder constituent of the coating or the substrate.

During this initial heat cycle, a chromium oxide bond is established between the coating and the substrate. This oxide bonding process is explained in applicant's U.S. Pat. Nos. 3,734,767; 3,789,096; and 3,925,575, and in particular U.S. Pat. No. 3,944,683 covering coatings assigned to the same assignee and incorporated herein by reference. In effect, it has been found that a chromium oxide bond, believed to be chemical in nature, is established between the thermally converted chromium oxide and other oxides that are either inherently present or are formed during the processing and in particular are formed during the heat conversion step.

For example, it is believed that the chromium oxide bond is made to an oxide layer that forms on the surface of the constituent metal particles of the coating. Bonding to the steel core is also undoubtedly possible because of the formation of a well adhering oxide coating that forms on a number of steel alloys during the processing steps, especially, of course, during the heat cure cycle. Bonding to aluminum oxide grains by the chromium oxide is understandable because the abrasive is already a refractory oxide. When silicon carbide grain is used, however, again it is believed that the chromium oxide bonds not to the silicon carbide but to a microthin layer of silicon oxide that forms on each silicon carbide grain.

Following the initial heat cycle, the applied coating is too soft for use at this point as a sharpening steel and must next be further bonded, densified and hardened. This is accomplished by impregnating the still porous coating with a solution of a soluble chromium metal compound capable of being converted to insoluble chromium oxide in situ. This impregnation-cure cycle procedure is repeated at least once and for a sufficient number of times to achieve the desired hardness and density. The additional chromium oxide conversions also establish an extremely strong bond between the particular coating constituents and also between the coating and the substrate.

A curing temperature of about 600° F. is adequate for conversion of the chromium compound but a higher temperature is often employed, e.g., 800° F.–1000° F. to allow for faster cure times because of the thermal mass of the substrate, etc. Temperatures as high as about 1500° F. may be considered in some instances but may also require the use of a non-oxidizing or inert atmosphere. Temperatures up to about 1000° F. may be used without the precaution of a non-oxidizing or inert atmosphere but temperatures above about 1000° F. in a normal atmosphere produces excessive oxidation of the metal powder. Higher cure temperatures are normally avoided so as not to over oxidize, deform or melt either the metal coating powder or the substrate and not to dull the sharp cutting edges of the abrasive grains. In addition, higher cure temperatures in general have been found to require a closer thermal expansion match between the coating and substrate.

The substrate or sharpening steel core to which the abrasive containing coating is to be bonded is normally a metal such as steel. A number of low cost steel alloys such as 1010–1020, 1045, 1080C, 1095, forged 1095, as well as some of the free machining alloys such as B1113 have been used successfully. Other metals such as 400 series stainless steel, titanium and bronze can also be used but are higher in cost. The 300 series stainless steels are not normally considered because of their relatively high thermal expansion rates which affects both the ease of bonding of the coating as well as limiting the amount of abrasive grain that can be included in the coating. This will be explained in more detail later.

The main criteria for a metal substrate is that it either be capable of forming or already have a well adhering oxide coating on its surface. Metals or alloys that form a poorly adhering oxide layer must be avoided as this will, of course, destroy the effectiveness of the chromium oxide bonding during the subsequent processing. Non-metal substrates such as refractory ceramics can, of course, be used but have not found much practical use because of their brittle nature.

The metal powder found to be most satisfactory in the slurry coating is manganese. This metal has a unique set of advantages which will be described below:

A. Because of its highly reducing characteristic, especially in finely divided form, manganese has a very strong affinity for oxygen. This aids considerably in the rapid conversion at a relatively low temperature of the chromium compound to the insoluble, lower oxidation state chromium oxide. An excellent chromium oxide bond is thereby established between the coating constituents and also between the coating and substrate.

B. Manganese metal has an exceptionally high thermal expansion rate compared to most other metals. This means that a reasonable amount of inherently low thermal expansion rate abrasive grain can be mixed with the manganese metal powder and still provide an overall expansion rate of the composite coating that will be compatible with commonly used substrate materials such as the ordinary steel alloys.

C. A processed sharpening steel using manganese metal powder as the metal coating constituent has been found to have the unusual advantage of being essentially non-loading in nature. By this it is meant that there is no tendency for the metal removed from a blade being sharpened to build up in or on the abrasive containing cutting surface beyond that of a superficial layer. This characteristic is no doubt in large part due to the almost complete lack of porosity in the processed coating. The affinity of manganese for oxygen during the heat cure cycles appears to cause this exceptionally low porosity in a relatively few impregnation-cure cycles.

D. Sharpening steels using chromium oxide bonded manganese powder-abrasive grain composite coatings have been found to provide an ideal combination of hardness, wear resistance and ductility. For example, the bonded manganese metal matrix is hard enough so that the cutting edge of a blade being sharpened has no tendency to cut into the matrix as there is a tendency to do when a softer metal such as aluminum metal powder is used. On the other hand, the manganese metal phase will wear away just sufficiently to expose new abrasive grain cutting surfaces as they may be required, while at the same time forming a very rigid matrix for holding the abrasive grains very firmly in place. The manganese metal has also been found to afford sufficient ductility so that a blow with a sharp instrument will simply cause a depression immediately under the point of impact and will not cause a fracture or massive failure as would be the case with a more brittle coating system.

A variety of abrasive grains have been successfully used as a constituent of the coating of these sharpening steels. Suitable abrasive grains include silicon carbide (black and green forms) as well as the various grades of aluminum oxide. The most successful grains for general sharpening steel use are the fused and crushed alumina grains made for the hone and grinding wheel industry. Many of these grains also contain impurities of iron oxide, titania, silica, zirconia, etc., to impart increased toughness. These fused alumina grains are tougher and less brittle than some of the refractory alumina or silicon carbide grains and have been found to hold their cutting edge with very little abrasive grain breakdown and therefore provide extremely long sharpening steel life. The alumina grain also has an advantage over that of silicon carbide in some instances because of the higher thermal expansion rate of the alumina. This allows more aluminum oxide than silicon carbide to be used in a coating formulation to achieve the same overall thermal expansion rate. Grit sizes that have been used successfully include 150, 220, 240, 280, 320, 420, 460, 600, 1000, 1200 grit aluminum oxides as well as silicon carbide and no grain.

It should be pointed out that the chromium oxide bonding also has been found to significantly increase the strength of the individual abrasive grains that are part of the composite coating. This is because the fractures and microcracks created during the crushing and grading of the abrasive are effectively re-bonded and strengthened during the multiple impregnation-cure treatment. Microscopic examination of sectioned abrasive grains that have been processed by this method show that the cracks and fissures and any exposed pores are indeed filled with chromium oxide. Crushing tests on such individual grains have shown a significant strength increase over untreated grains.

The percentage of abrasive grain used in the coating can be varied over quite wide ranges and still provide a usable sharpening steel. The main consideration is not to use too much abrasive grain to the point where the thermal expansion of the coating becomes too low for that of the substrate. If this point is exceeded, the coating will not adhere during or following the heating and cooling cycles. On the other hand, even a powdered manganese metal coating containing no added abrasive grain will adhere to many substrates including steel. This is no doubt due to the ductility of the metal that provides for a considerable accommodation in coating to substrate expansion mismatch. Incidentally, a sharpening steel with no added abrasive grain still provides a fine cutting action because of the extremely hard chromium oxide crystalline structure formed during the bonding process. Basically, as one uses finer grit sizes of abrasive grain in a coating formulation, the amount by weight of abrasive grain diminishes.

Suspension agents such as Kaolin, Cab-O-Sil, etc. may be added to the sharpening steel slurry formulation as explained above. The purpose of these additives is to cause the metal and abrasive powders to stay in suspension for longer periods of time than would otherwise be the case. This results in a more uniform and more easily applied coating. Fortunately, only a very small amount of these suspending agents are required and no adverse effect on cutting properties has been detected, providing excessive amounts of these agents are not used. In addition to the suspension agents, it is also preferred practice to keep the slurry constantly stirred during the time the steels are being coated.

The chromium compound used as the binder in the coating slurry must be water soluble and can be selected from among a large group of hexavalent chromium materials. Reference is made to applicant's U.S. Pat. No. 3,956,531 which covers a large selection of such compounds including mixtures of hexavalent and trivalent systems and is incorporated herein by reference. A further restriction when using a slurry coating formulation containing manganese metal powder is that substantially no adverse chemical reaction occur. It has been found that a relatively neutral chromium compound for the first impregnation is essential to prevent gas evolution by the manganese metal. This is true in spite of the fact that hexavalent chromium is a well-known corrosion inhibitor.

A relatively neutral soluble hexavalent chromium compound meeting the above requirements is shown in the example below:

ZC-2 binder preparation

The ZC-2 solution is prepared from the following percent solid constituents by weight:

ZnO: 28.9%

$CrO_3$: 71.1%

The zinc chromate solution is prepared by dissolving 300 grams of chromic anhydride in distilled water to give a total volume of about 450 ml. Then 122 grams of ZnO is added and mixed until the reaction is complete. The specific gravity of the solution is then adjusted to 1.65 g/cc$^3$ by dilution with distilled water. The solution is generally made in a concentrated form and then diluted to a lower level of concentration as needed.

Other similar binders have been used successfully and include compounds where the zinc has been substituted by calcium, cobalt, magnesium and lithium, as follows:

TABLE I

| Designation | $CrO_3$ | Amount | Second Material | Amount | Specific Gravity |
|---|---|---|---|---|---|
| 1. ZC-2 | $CrO_3$ | 100g | ZnO | 40.7 | 1.65 |
| 2. CAC-2 | $CrO_3$ | 100g | CaO | 28.1g | 1.65 |
| 3. COC-2 | $CrO_3$ | 100g | $CoCO_3$ | 59.5g | 1.65 |
| 4. MC-2 | $CrO_3$ | 100g | MgO | 20.2g | 1.65 |
| 5. MC-1 | $CrO_3$ | 100g | MgO | 40.3g | 1.5 |
| 6. LIC-2 | $CrO_3$ | 100g | $Li_2CO_3$ | 18.5g | 1.65 |

In all the above examples as listed in the table, the amount of chromic acid is first dissolved in water. Then the second material listed is added in the amount as specified. For example, to make CAC-2, 100 grams of $CrO_3$ is first dissolved in water. Then 28.1 grams of CaO is added. After the reaction is complete, the specific gravity is adjusted to about 1.65g/cc$^3$. The solutions are generally made in a concentrated form and then diluted to a lower level of concentration as needed. All the solutions listed above are prepared in a similar fashion to CAC-2. The compounds which were substituted for zinc are calcium oxide, CaO, cobalt carbonate, $CoCO_3$, magnesium oxide, MgO, and lithium carbonate, $Li_2CO_3$.

Examples of coating slurries that have provided excellent results are as follows. It will be obvious that many other variations are possible and these have been selected merely to show typical examples as well as variations in some of the constituent parts.

| Slurry Coating Formulation #1 | Dry Weight Percent |
|---|---|
| Manganese (Alcan Metal Powders - type MD-301, −325 mesh) | 71.94% |
| 240 Grit Aluminum Oxide (Exolon fused alumina grain - brown grade) | 22.78% |
| Peerless #2 Kaolin | 4.80% |
| Cab-O-Sil (Type M-5) | .48% |

To every 100 grams of the above formulation, 19.2 ml of a diluted ZC-2 solution is added. This diluted ZC-2 solution is prepared by adding one part ZC-2 solution of specific gravity 1.65g/cc$^3$ to two (2) parts distilled water by volume. The slurry is then adjusted to the desired viscosity and specific gravity.

| Slurry Coating Formulation #2 | Dry Weight Percent |
|---|---|
| Manganese (MD-301, −325 mesh) | 87.7% |
| 1000 Grit Aluminum Oxide (#95 crystal finishing powder, KC Abrasives Co.) | 9.7% |
| Peerless #2 Kaolin | 2.6% |

The binder for this formulation is prepared by adding one part ZC-2 solution of specific gravity 1.65g/cc$^3$ to two (2) parts distilled water by volume. Enough binder solution is then added to the powders to achieve a slurry of the desired viscosity and specific gravity.

| Slurry Coating Formulation #3 | Dry Weight Percent |
|---|---|
| Manganese (MD-301, −325 mesh) | 71.8% |
| 600 Grit Aluminum Oxide (#175 crystal finishing powder, KC Abrasives Co.) | 23.9% |
| Peerless #2 Kaolin | 4.3% |

The binder for this formulation is prepared by adding one part ZC-2 solution of specific gravity 1.65g/cc$^3$ to two (2) parts distilled water by volume. Enough binder solution is then added to the powders to achieve a slurry of the desired viscosity and specific gravity.

| Slurry Coating Formulation #4 | Dry Weight Percent |
|---|---|
| Manganese (MD-301, −325 mesh) | 74.2% |
| 220 Grit Aluminum Oxide (Exolon fused alumina grain - brown grade) | 24.8% |
| Cab-O-Sil (Type M-5) | 1.0% |

The binder for this formulation is prepared by adding one part ZC-2 solution of specific gravity 1.65g/cc$^3$ to two (2) parts distilled water by volume. Enough binder solution is then added to the powders to achieve a slurry of the desired viscosity and specific gravity.

| Slurry Coating Formulation #5 | Dry Weight Percent |
|---|---|
| Manganese (MD-301, −325 mesh) | 82.9% |
| 320 Grit Aluminum Oxide (Exolon fused alumina grain - | |

-continued

| Slurry Coating Formulation #5 | Dry Weight Percent |
|---|---|
| brown grade) | 12.4% |
| Peerless #2 Kaolin | 4.1% |
| Cab-O-Sil (Type M-5) | .6% |

The binder for this formulation is prepared by adding one part ZC-2 solution of specific gravity 1.65g/cc$^3$ to two (2) parts distilled water by volume. Enough binder solution is then added to the powders to achieve a slurry of the desired viscosity and specific gravity.

| Slurry Coating Formulation #6 | Dry Weight Percent |
|---|---|
| Manganese (MD-301, −325 mesh) | 75.1% |
| 320 Grit Aluminum Oxide (Exolon fused alumina grain - brown grade) | 18.8% |
| Peerless #2 Kaolin | 5.6% |
| Cab-O-Sil (Type M-5) | .5% |

The binder for this formulation is prepared by adding one part ZC-2 solution of specific gravity 1.65g/cc$^3$ to two (2) parts distilled water by volume. Enough binder solution is then added to the powders to achieve a slurry of the desired viscosity and specific gravity.

Although the above examples use ALCAN MD-301 powdered manganese, ALCAN MD-201 and MD-101 and other brands of manganese powders such as Cerac manganese metal powder have been used with success. ALCAN MD-201 and MD-101 are -200 mesh and -100 mesh respectively.

As mentioned previously, the slurry coating, after being applied to the substrate, is then dried and heat cured to establish the initial chromium oxide bond. The coating at this point is, however, far too soft for use. Additional chromium oxide bonding, densification and hardening is achieved by means of multiple impregnation-cure cycles with a suitable chromium compound. From two to five impregnation and cure cycles appear to produce preferred results.

We have found that the manganese metal involved in the coating composition is no longer highly reactive to an acidic chromium solution following the initial cure cycle. This may be due to the formation of a protective oxide layer on the exposed manganese grains. Therefore, a large number of soluble chromium compounds can be employed for this multiple impregnation-heat cure processing step. These include water solutions of chromic anhydride ($CrO_3$), usually called chromic acid when mixed with water ($H_2CrO_4$), a wide variety of dichromates, chromates and mixtures of chromates with chromic acid. Mixtures of hexavalent and trivalent chromium compounds can also be considered as covered in more detail in U.S. Pat. No. 3,956,531.

One impregnant selected for use in a good many of our tests and subsequent production of sharpening steels was a mixture of zinc chromate and chromic acid with proportions as listed below as ZC-5:

ZC-5 Preparation

The ZC-5 solution is prepared from the following percent solid constituents by weight.

ZnO: 14.0%

$CrO_3$: 86.0%

This zinc chromate solution is prepared by dissolving 100 pounds chromic acid in distilled water to give a specific gravity of about 1.6. Then 16.3 pounds of ZnO is added and mixed until the reaction is complete. The specific gravity of the solution is then adjusted to 1.65g/cc$^3$ by dilution with distilled water. The solution is generally made in a concentrated form and then diluted to a lower level of concentration as needed.

A solution of this type was found to densify the porous coating with a minimum number of impregnation-cure cycles . . . at least one less cycle than if chromic acid alone were used. On the other hand, this zinc chromate-chromic acid impregnant provided a noticeably stronger and harder bond than if a dichromate were used such as the zinc dichromate described earlier for use as the binder in the slurry coating. The zinc containing impregnants were selected over many other similar possibilities mainly because of the relatively low cost of the zinc oxide and its rapid dissolution in chromic acid during preparation of the solutions.

The impregnant is normally applied by dipping the coated steel in the aqueous chromium solution, although other application means are possible such as spraying and, pressure and vacuum impregnation, etc.

A relatively dilute chromium solution is preferably employed as the impregnating solution. This eliminates the time consuming process of wiping off or otherwise removing excess impregnant. Excess impregnant is not desirable as it tends to build up a chromium oxide layer on the surface of the coating after a few impregnation-cure cycles. It has been found that with proper adjustment of the water content of the zinc containing impregnant that virtually no excess impregnant will remain on the surface of the steel. As the excess water evaporates from the dipped coating surface, the more concentrated impregnant has been found to migrate into the pores of the coating. If this dilution of the binder solution is done in moderation, it results in a coating quite similar in hardness as one treated in a concentrated binder solution.

As mentioned earlier, the slurry coating may be applied to the substrate by a number of methods including spraying, brushing, dipping, etc. The system we have found that gives the most uniform coating thickness and overall coating smoothness is the dipping method. In this system, the substrate, usually a steel core, is simply dipped into a tank containing constantly mixed coating slurry. The core is then slowly withdrawn, at a predetermined and uniform rate. The rate of core withdrawal from the slurry is somewhat critical in order to obtain a consistent coating thickness from one steel to the next as well as achieving a uniform surface finish. The specific gravity of the coating may also need to be adjusted from time to time by adding additional water as the moisture leaves thru evaporation.

The coating thickness found to be most suitable for general purpose sharpening steels ranges from about 0.0025 to about 0.008 inch. Coating failure may result if the coating is too thin due to deformation of the substrate under high pressure on the coating surface. On the other hand, very thick coatings require a closer thermal expansion match to that of the substrate and causes an unnecessary use of expensive coating materials.

Prior to dipping the steel core or other substrate in the slurry, it is usually customary to make sure that any grease, dirt or other foreign matter is removed that may interfere with proper slurry adhesion. Metal substrates are also usually acid etched, grit blasted, tumbled with abrasive grit, etc., to remove any loose oxide or scale that may be present as a result of rolling, forming, forging, etc. Roughening of the surface in this matter also aids in achieving a higher coating-to-substrate bond strength and also allows a greater thermal expansion mismatch between coating and substrate because of the greater effective surface area at the interface.

The type MD-301 manganese powder is available from Alcan Metal Powders, a division of Alcan Aluminum Corp., Elizabeth, New Jersey; the Exolon fused alumina grain is available from Exolon Co. of Tonawanda, New York, through KC Abrasives Co. of Kansas City, Kansas; the Peerless #2 Kaolin is available from R. T. Vanderbilt, New York, New York; the Cab-O-Sil (Type 5) is available from Cabot Corp., Boston, Massachusetts; and, the #95 and #175 crystal finishing powders are available from KC Abrasives Co. of Kansas City.

The following range of sharpening steel sizes have been made to date:

1. Professional Steel
   12 inches long
   maximum diameter: 9/16 inch
   minimum diameter: 3/16 inch
2. Mini Steel
   3½ inches long
   maximum diameter: 3/16 inch
   minimum diameter: ⅛ inch
3. Flat Steel
   1 inch wide
   4 inches long
   ⅛ inch thick
   0.020—0.030 inch radius
4. Double Sided Flat Steel
   180 grit one side
   320 grit other side
   Sprayed on flat steel

What is claimed is:

1. A method of making a sharpening tool having an abrasive surface which comprises:

providing a substrate of metal having an oxide coating formed thereon;

applying a coating on the substrate of a slurry containing a relatively hard, ductile metal powder, an amount of abrasive grain and impregnated with a binder consisting of a soluble inorganic chromium compound convertible to an insoluble chromium compound upon heating;

heat curing the slurry coated substrate to convert the chromium compound to an insoluble chromium compound at a temperature of at least 600° F. but below a temperature sufficiently high to excessively oxidize, melt and deform either the metal powder, the metal substrate and/or the abrasive grain; and, repeating the impregnation of the slurry coating with a solution of a soluble chromium compound and heat curing cycle at least once.

2. The method of claim 1 wherein the oxide coating on the metal substrate is formed in situ.

3. The method of claim 1 wherein the metal substrate is selected from the group consisting of steel, steel alloys 1010-1020, 1045, 1080C, 1095, forged 1095, B1113, 400 series stainless steel, titanium and bronze.

4. The method of claim 1 wherein the metal substrate is steel.

5. The method of claim 1 wherein the metal powders of the slurry are selected from the group consisting of manganese and aluminum.

6. The method of claim 1 wherein the solution of soluble chromium compound used for the first impregnation is substantially neutral and does not significantly react with the powdered metal.

7. The method of claim 1 wherein the metal powder is manganese.

8. The method of claim 1 wherein the heat curing is carried out at temperatures from about 600° F. to about 1000° F.

9. The method of claim 1 wherein a heat curing step carried out at temperatures in excess of 1000° F. is in a non-oxidizing atmosphere.

10. The method of claim 1 wherein the abrasive grain is selected from the group consisting of aluminum oxide, silica carbide and fused and crushed aluminum oxide grains.

11. The method of claim 1 wherein the abrasive grains are fused and crushed aluminum oxide grains.

12. A sharpening tool comprising a metal substrate having adhered thereto a coating of closely packed porous mesh of finely divided discrete particles at least the surface of which consists of a refractory oxide of at least one metallic element having a vitrification temperature in excess of 600° F. essentially devoid of vitreous and/or sinter bonding between the particles being bonded together by chromic oxide formed at temperatures below about 1000° F. having substantial deposits of chromic oxide within the pores thereof wherein at least a portion of the particles is powdered metal and another portion is abrasive grain.

13. The tool of claim 12 wherein the powdered metal is manganese metal.

14. The tool of claim 13 wherein the coating contains abrasive grains selected from the group consisting of aluminum oxide and silicon carbide.

15. The tool of claim 14 wherein the coating is from about 0.0025 to about 0.008 inches in thickness.

* * * * *